US011670883B2

(12) United States Patent
Zhao et al.

(10) Patent No.: US 11,670,883 B2
(45) Date of Patent: Jun. 6, 2023

(54) ELECTRICAL CONNECTOR HAVING A ROW OF RIGHT-ANGLE CONTACTS FORMED WITH BEARING PORTIONS FOR EASE OF MANUFACTURING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 117 days.

(21) Appl. No.: 17/201,377

(22) Filed: Mar. 15, 2021

(65) Prior Publication Data

US 2021/0288424 A1 Sep. 16, 2021

(30) Foreign Application Priority Data

Mar. 16, 2020 (CN) ..... 202010180880.0

(51) Int. Cl.
*H01R 12/72* (2011.01)
*H01R 13/405* (2006.01)
(Continued)

(52) U.S. Cl.
CPC ..... *H01R 12/724* (2013.01); *H01R 13/405* (2013.01); *H01R 13/516* (2013.01);
(Continued)

(58) Field of Classification Search
CPC ..... H01R 13/6471; H01R 12/775; H01R 13/6582; H01R 13/6585
See application file for complete search history.

(56) References Cited

U.S. PATENT DOCUMENTS 7,748,999 B1 * 7/2010 Sun ..... H01R 12/716 439/660
7,967,631 B2 * 6/2011 Wang ..... H01R 13/648 439/541.5
(Continued)

FOREIGN PATENT DOCUMENTS

CN 101740989 A 6/2010
CN 105305132 A 2/2016
(Continued)

*Primary Examiner* — Truc T Nguyen
(74) *Attorney, Agent, or Firm* — Ming Chieh Chang

(57) ABSTRACT

A method of making a contact module of an electrical connector which includes a front tongue and an upper and lower rows of contacts with contacting portions exposed to two opposite surfaces of the tongue is characterized by the steps of: forming a first insulator to the lower row of contacts to have a base, a lower upright portion, and a rear mounting portion; mounting the upper row of contacts to the first insulator by inserting tails of the upper row of contacts through the mounting portion of the first insulator until respective bearing portions of the upper row of contacts bear against the mounting portion; removing a carrier strip from the bearing portions of the upper row of contacts; and molding a second insulator with the upper and lower rows of contacts and the first insulator to expose the upper and lower contacting portions.

16 Claims, 14 Drawing Sheets

(51) Int. Cl.

| | |
|---|---|
| ***H01R 43/24*** | (2006.01) |
| ***H01R 13/6585*** | (2011.01) |
| ***H01R 24/60*** | (2011.01) |
| ***H01R 13/516*** | (2006.01) |

(52) U.S. Cl.
CPC ..... *H01R 13/6585* (2013.01); *H01R 24/60* (2013.01); *H01R 43/24* (2013.01)

(56) References Cited

U.S. PATENT DOCUMENTS

| | | | | |
|---|---|---|---|---|
| 8,591,258 | B2 * | 11/2013 | Xiao | H01R 12/724 439/607.25 |
| 9,466,924 | B2 * | 10/2016 | Lin | H01R 13/6585 |
| 9,496,664 | B2 * | 11/2016 | Little | H01R 24/60 |
| 9,673,569 | B2 * | 6/2017 | Zhang | H01R 13/6585 |
| 9,882,316 | B2 | 1/2018 | Chen et al. | |
| 9,893,473 | B2 * | 2/2018 | Kong | H01R 13/658 |
| 10,218,134 | B2 * | 2/2019 | Tsai | H01R 24/60 |
| 10,411,389 | B2 * | 9/2019 | Zhao | H01R 13/504 |
| 10,476,195 | B2 * | 11/2019 | Duan | H01R 43/16 |
| 10,862,249 | B2 * | 12/2020 | Ju | H01R 12/724 |
| 2015/0270661 | A1 * | 9/2015 | Kao | H01R 13/6585 439/271 |
| 2017/0117673 | A1 * | 4/2017 | Zhang | H01R 13/516 |
| 2018/0097298 | A1 * | 4/2018 | Ju | H01R 24/60 |
| 2022/0271458 | A1 * | 8/2022 | Wang | H01R 13/6471 |

FOREIGN PATENT DOCUMENTS

| | | | |
|---|---|---|---|
| CN | 108173020 | A | 6/2018 |
| CN | 209822907 | U | 12/2019 |

* cited by examiner

ELECTRICAL CONNECTOR HAVING A ROW OF RIGHT-ANGLE CONTACTS FORMED WITH BEARING PORTIONS FOR EASE OF MANUFACTURING

BACKGROUND OF THE INVENTION

1. Field of the Invention

The present invention relates to a method of making a contact module of an electrical connector which includes a front tongue with two opposite surfaces and an upper and lower rows of contacts with contacting portions exposed to the two opposite surfaces of the tongue, wherein the lower row of contacts is first molded with a first insulator and then the upper row of contacts is separately mounted to the first insulator, characterized by a step of inserting tails of the upper row of contacts through a mounting portion of the first insulator in order to facilitate manufacturing of the contact module, and wherein a second insulator is molded with the upper and lower rows of contacts and the first insulator.

2. Description of Related Arts

China Patent No. 209822907 discloses an electrical connector including, among others, an upper contact unit and a lower contact unit both having right-angle contacts with long vertical portions. These long vertical portion of the contracts are prone to deform if not properly supported during manufacturing.

SUMMARY OF THE INVENTION

A method of making a contact module of an electrical connector which includes a front tongue with two opposite surfaces and an upper and lower rows of contacts with contacting portions exposed to the two opposite surfaces of the tongue is characterized by the steps of: forming a first insulator to the lower row of contacts to have a base, a lower upright portion, and a rear mounting portion; mounting the upper row of contacts to the first insulator by inserting tails of the upper row of contacts through the mounting portion of the first insulator until respective bearing portions of the upper row of contacts bear against the mounting portion; removing a carrier strip from the bearing portions of the upper row of contacts; and molding a second insulator with the upper and lower rows of contacts and the first insulator to expose an upper and lower contacting portions of the upper and lower rows of contacts while embedding the bearing portions of the upper row of contacts.

DETAILED DESCRIPTION OF THE PREFERRED EMBODIMENT

Figure 1:
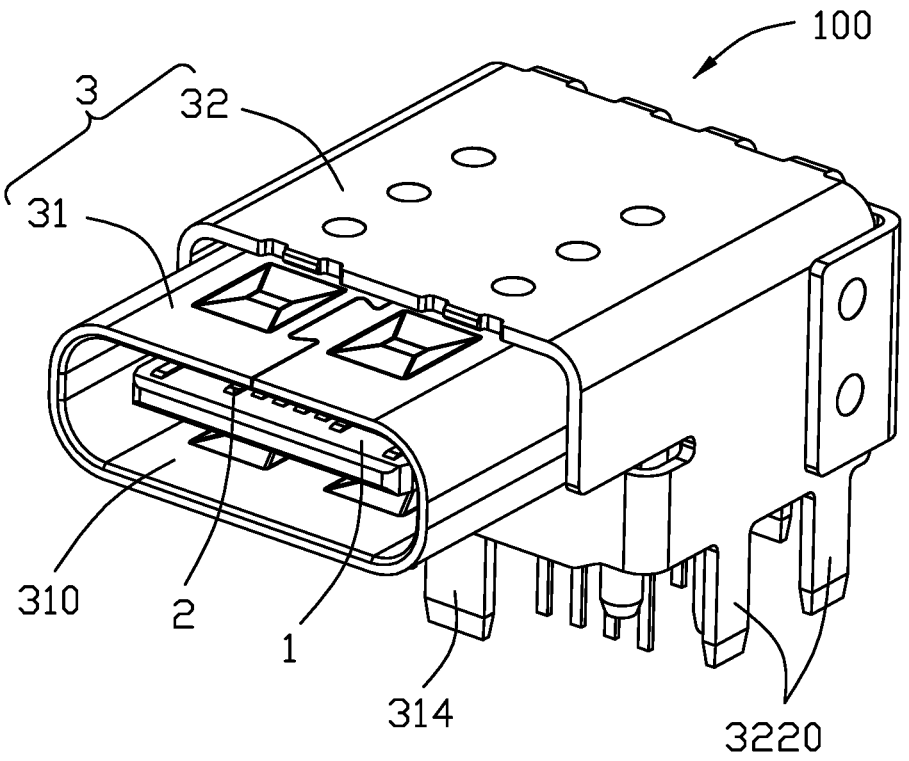
FIG. 1 is a perspective view of an electrical connector in accordance with the present invention.
Figure 2:
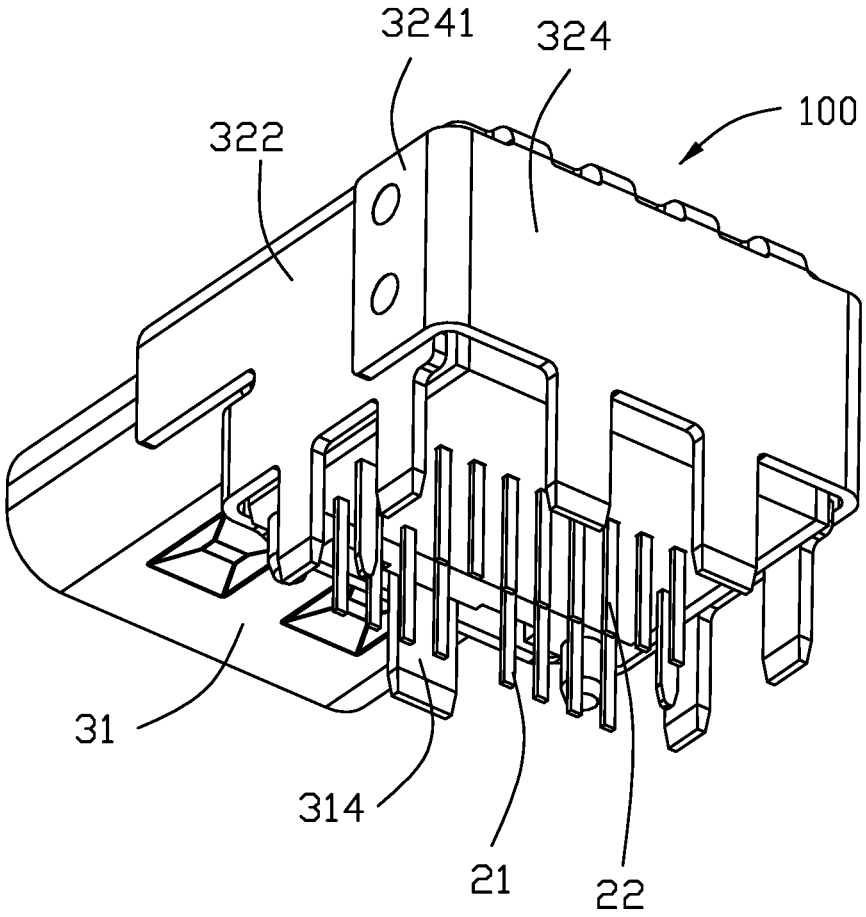
FIG. 2 is a perspective view of the electrical connector from another perspective.
Figure 3:
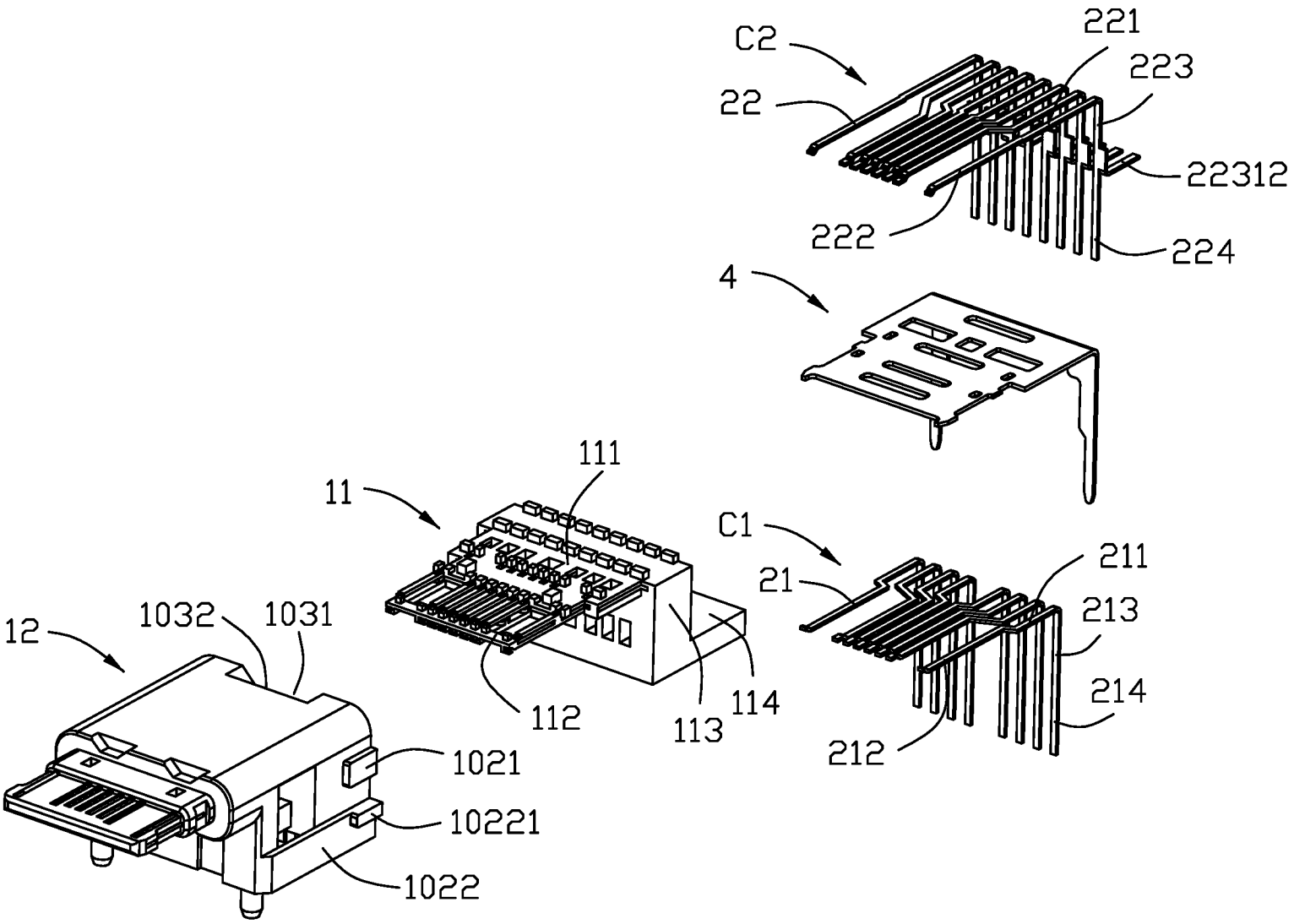
FIG. 3 is an exploded view of a contact module of the electrical connector in FIG. 1.
Figure 4:
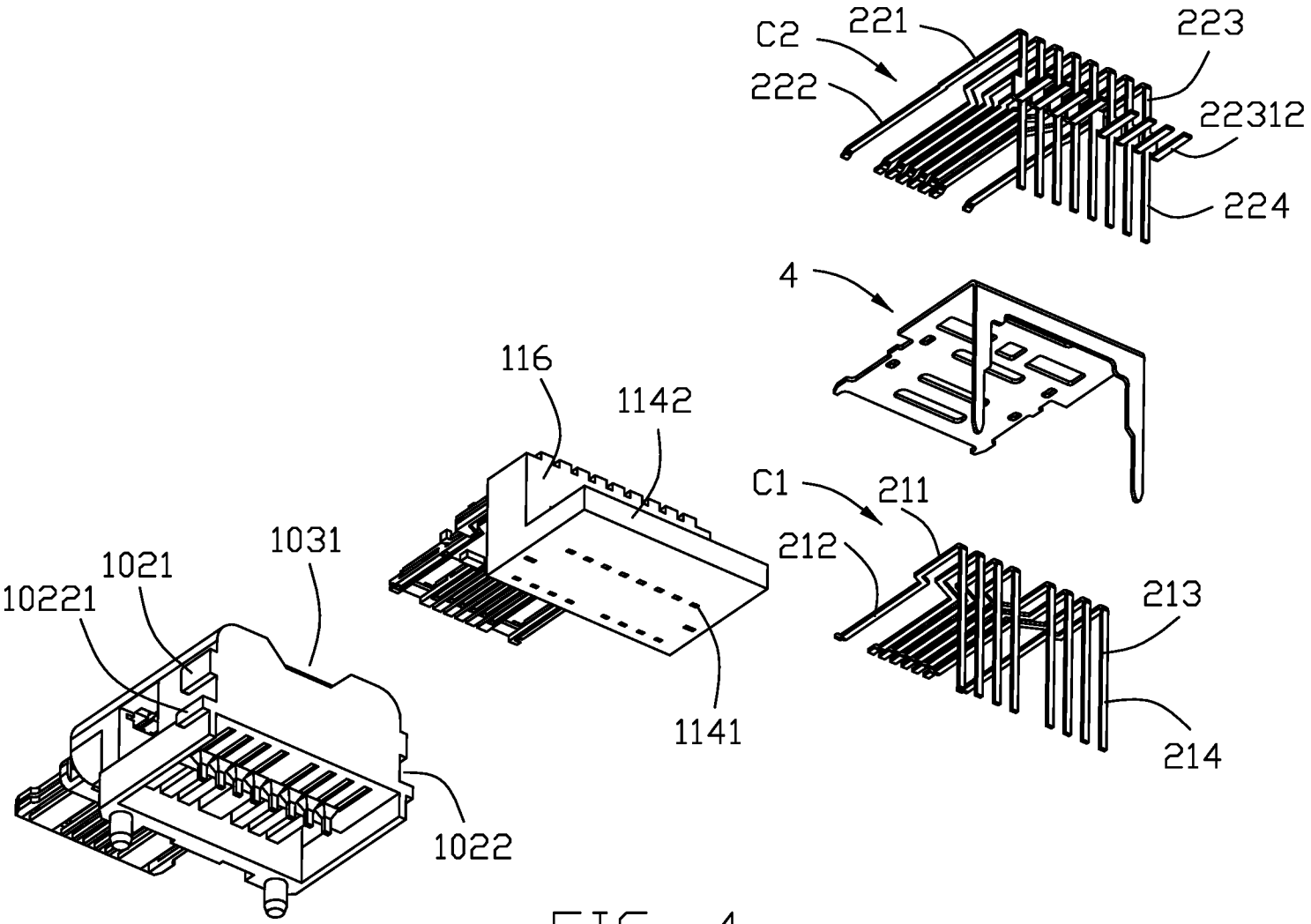
FIG. 4 is an exploded view of the contact module in FIG. 3 from another perspective.
Figure 5:
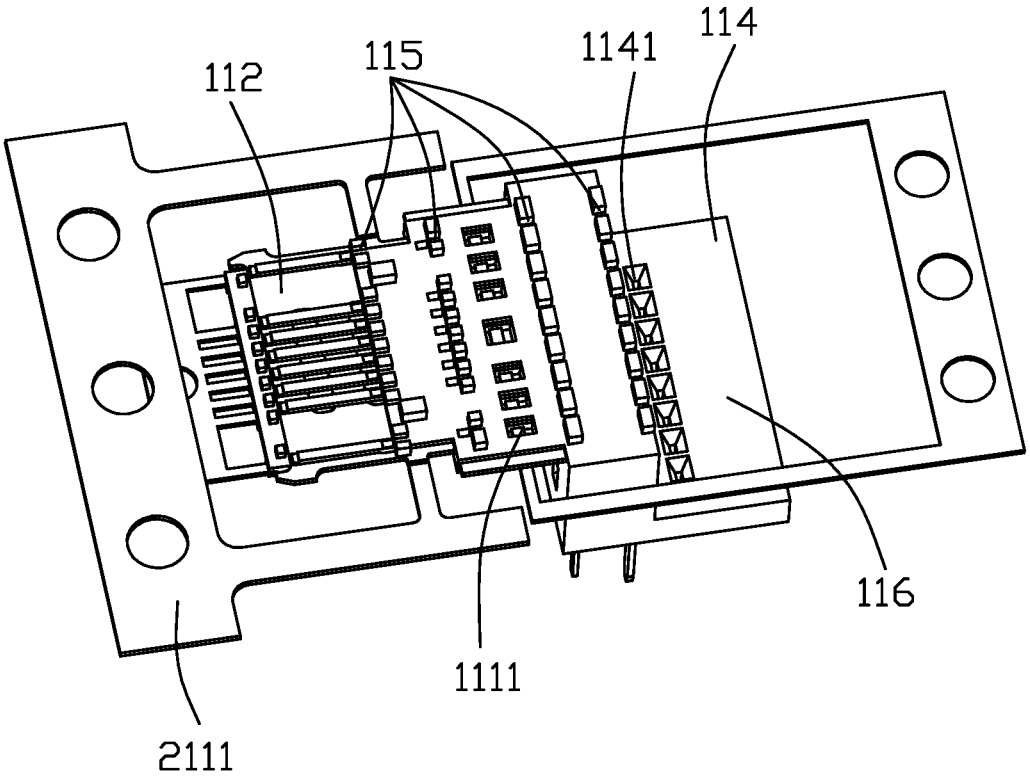
FIG. 5 shows an intermediate state of manufacturing the contact module.
Figure 6:
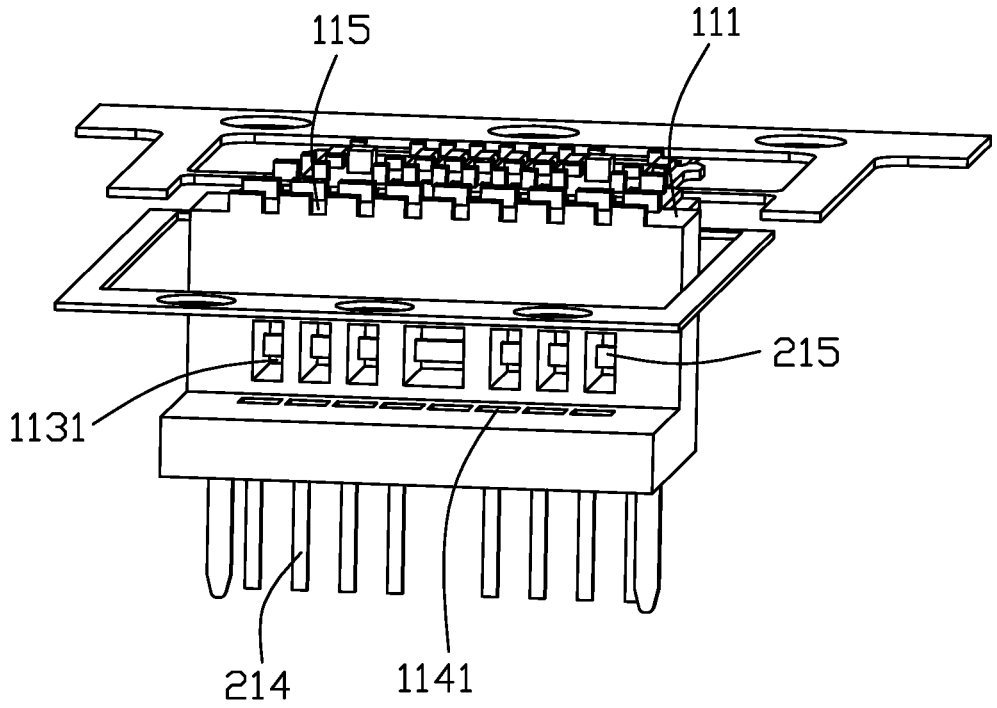
FIG. 6 shows the state of FIG. 5 from another perspective.
Figure 7:
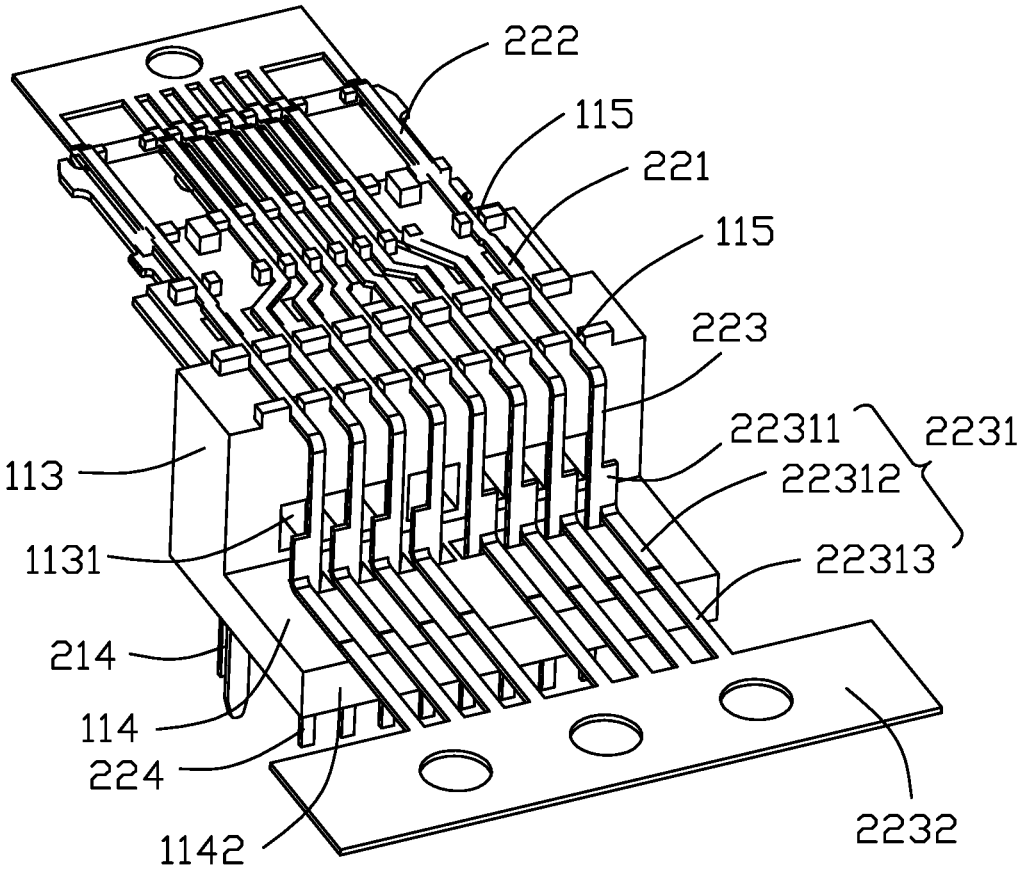
FIG. 7 shows another intermediate state of manufacturing the contact module.
Figure 8:
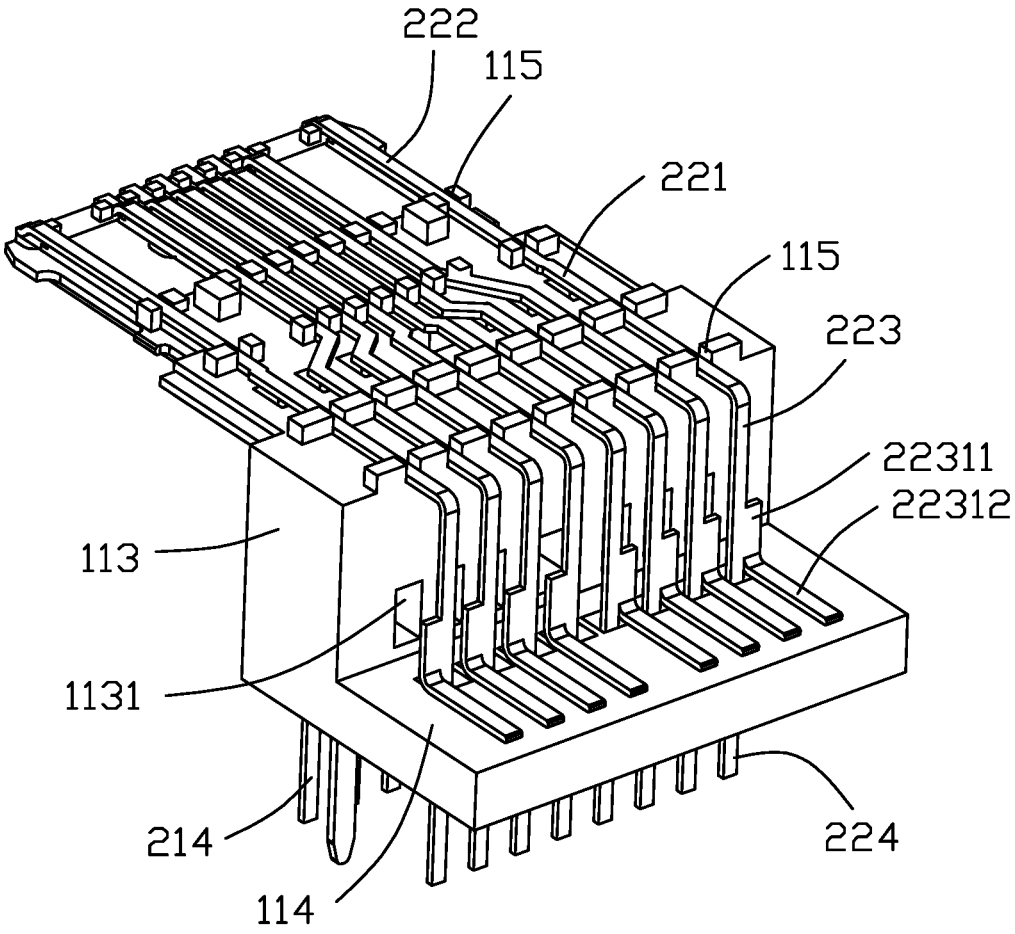
FIG. 8 shows the state of FIG. 7 after removing a carrier strip.
Figure 9:
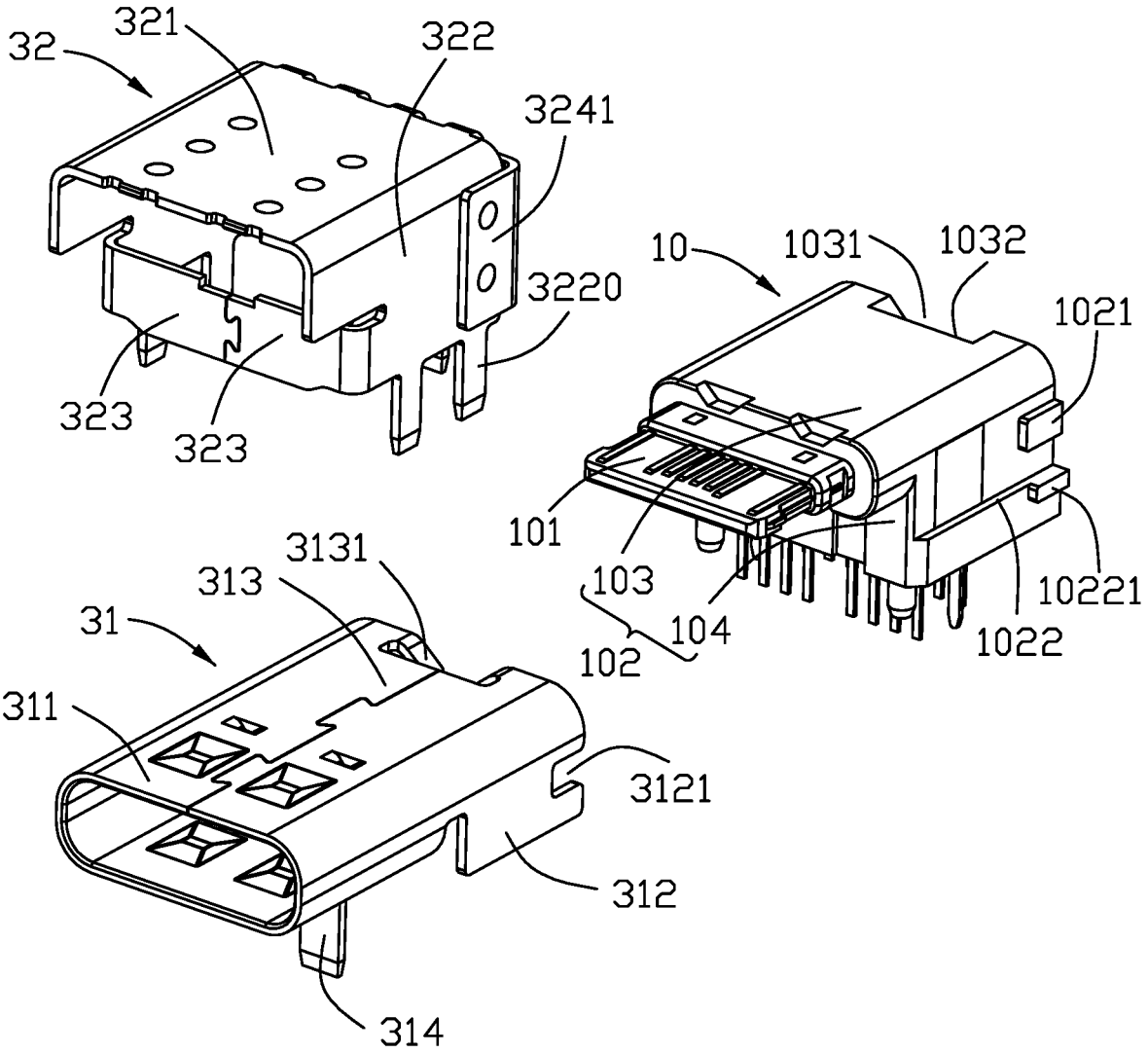
FIG. 9 is an exploded view of the electrical connector in FIG. 1.
Figure 10:
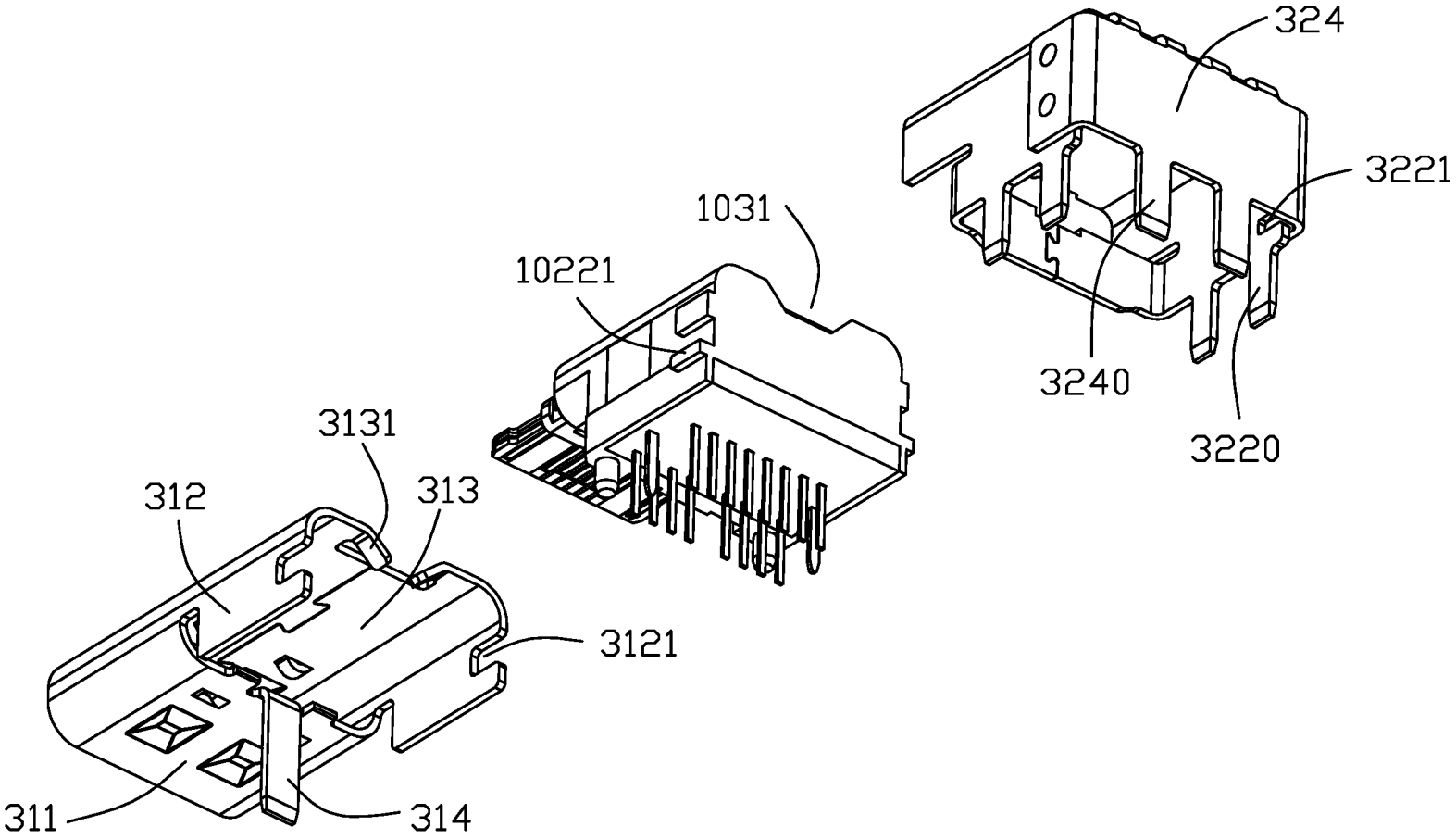
FIG. 10 is an exploded view of the electrical connector in FIG. 2.

Referring to FIGS. 1-12, an electrical connector 100 comprises an insulative housing 1 consisting of a first insulator 11 and a second insulator 12, and a first and second rows C1 and C2 of contacts 21 and 22 secured in the insulative housing 1 to together form a contact module 10. The electrical connector 100 may further comprise a middle shielding plate 4 and a shielding shell 3 consisting of a primary shell 31 and an auxiliary shell 32.

The first insulator 11 is insert molded with the first row of contacts 21 and the shielding shell 3 if present and has a base 111, a tongue 112, an upright portion 113, and a mounting portion 114. The first contact 21 has a securing portion 211, a contacting portion 212, an upright portion 213, and a tail 214.

During manufacturing, the upright portions 213 of the first contacts 21 are originally connected by bridges 215. The upright portion 113 of the first insulator 11 has corresponding holes 1131 for severing the bridges 215, preferably after the first insulator 11 is insert molded with the first row of contacts 21. The provision of bridges 215 helps stabilizing the long and slender upright portions 213 of the first contacts 21.

The second row of contacts 22 are mounted to the first insulator 11 along a top-to-down direction and then the second insulator 12 is molded to the sub-assembly. The second contact 22 has a securing portion 221, a contacting portion 222, an upright portion 223, and a tail 224. At least one of the base 111 and the tongue 112 has plural grooves 115, the mounting portion 114 has plural holes 1141, and a receiving space 116 is defined between an upper surface of the mounting portion 114 and a rear surface of the upright portion 113. When the second row of contacts 22 are mounted to the first insulator 11, at least corresponding ones of the securing portions 221 and the contacting portions 222 are mounted to the grooves 115, the upright portions 223 are accommodated in the receiving space 116, and the tails 224 extend downwardly through the holes 1141. In view of the relatively long upright portion 223 and tail 224 as a whole, in order to ensure coplanarity of the tails 224 and stability of the upright portion 223 during a molding process, the contact 22 further has a bearing strip 2231 beside the upright portion 223. The bearing strip 2231 bears downward against the upper surface of the mounting portion 114 of the first insulator 11 during manufacturing and are connected by a carrier strip 2232 to be severed later. The bearing strip 2231 includes a connecting part 22311 coplanar with the upright portion 223, a bent part 22312 for bearing against the upper surface of the mounting portion 114, and a rear severing part 22313 connected to the carrier strip 2232. Before molding the second insulator 12, the carrier strip 2232 and the severing parts 22313 are removed; after molding the second insulator 12, the contacting portions 212 and 222 of the upper and lower rows of contacts 22 and 21 are exposed while the connecting parts 22311 and the bent parts 22312 of the upper row of contacts 22 are embedded for esthetic purpose.

In addition, the securing portions 211 of the first lower contacts 21 are mutually connected by plural bridges of the carrier strip 2111 which will be later severed through corresponding holes 1111 of the insulator base 111 preferably right after molding the first insulator 11 with the contacts 21.

The second insulator 12 over-molds the tongue 112 of the first insulator 11 to form a tongue 101 of the insulative housing 1; the second insulator 12 over-molds the base 111, the upright portion 113, and the mounting portion 114 of the first insulator 11 to form a base 102 of the insulative housing 1. The base 102 has a pair of side protrusions 1021 and a pair of side steps 1022 below the pair of side protrusions 1021. The primary shell 31 has a tubular portion 311 which together with the tongue 101 defines a mating chamber 310, a pair of side wings 312, a top wall 313 between the pair of wings 312, and a soldering leg 314 extending downward from a rear edge of the tubular portion 311. Each side wing 312 has a notch 3121 for engaging the side protrusion 1021. The base 102 is constructed to have a base portion 103 and an upright portion 104 below the base portion 103. The side protrusions 1021 and the side steps 1022 protrude from the base portion 103. The tubular portion 311 is secured to the base portion 103. In addition, the base portion 103 has a groove 1031 with a limiting face 1032 and the primary shell 31 has a pair of fingers 3131. The side protrusions 1021 engage the notches 3121 and the upright portion 104 abuts the tubular portion 311 so the insulative housing 1 is prevented from further moving forward. The fingers 3131 abut the face 1032 so the insulative housing 1 is prevented from further moving backward. The side steps 1022 support the wings 312 so that the primary shell 31 is stably supported to prevent mis-alignment of the shell relative to the tongue 101.

The secondary shell 32 includes a top wall 321 welded to the tubular portion 311 and the top wall 313 of the primary shell 31, a pair of side walls 322, a pair of front guards 323, and a rear wall 324. The guards may be connected by a dove-tailed structure and may be spot welded to the leg 314. The rear wall 324 has a pair of fixing pieces 3241 secured to the side walls 322. The base 102 of the insulative housing 1 has a pair of ribs 10221 protruding from the side steps 1022. The secondary shell 32 has a pair of notches 3221 engaging the pair of ribs 10221. Assembled insulative housing 1 and primary shell 31 are mounted forwardly to the secondary shell 32 until the upright portion 104 and the leg 314 abut the front guards 323 where the ribs 10221 engage the notches 3221. In addition, the side wall 322 has soldering legs 3220 and the rear wall 324 has soldering legs 3240.

Figure 11:
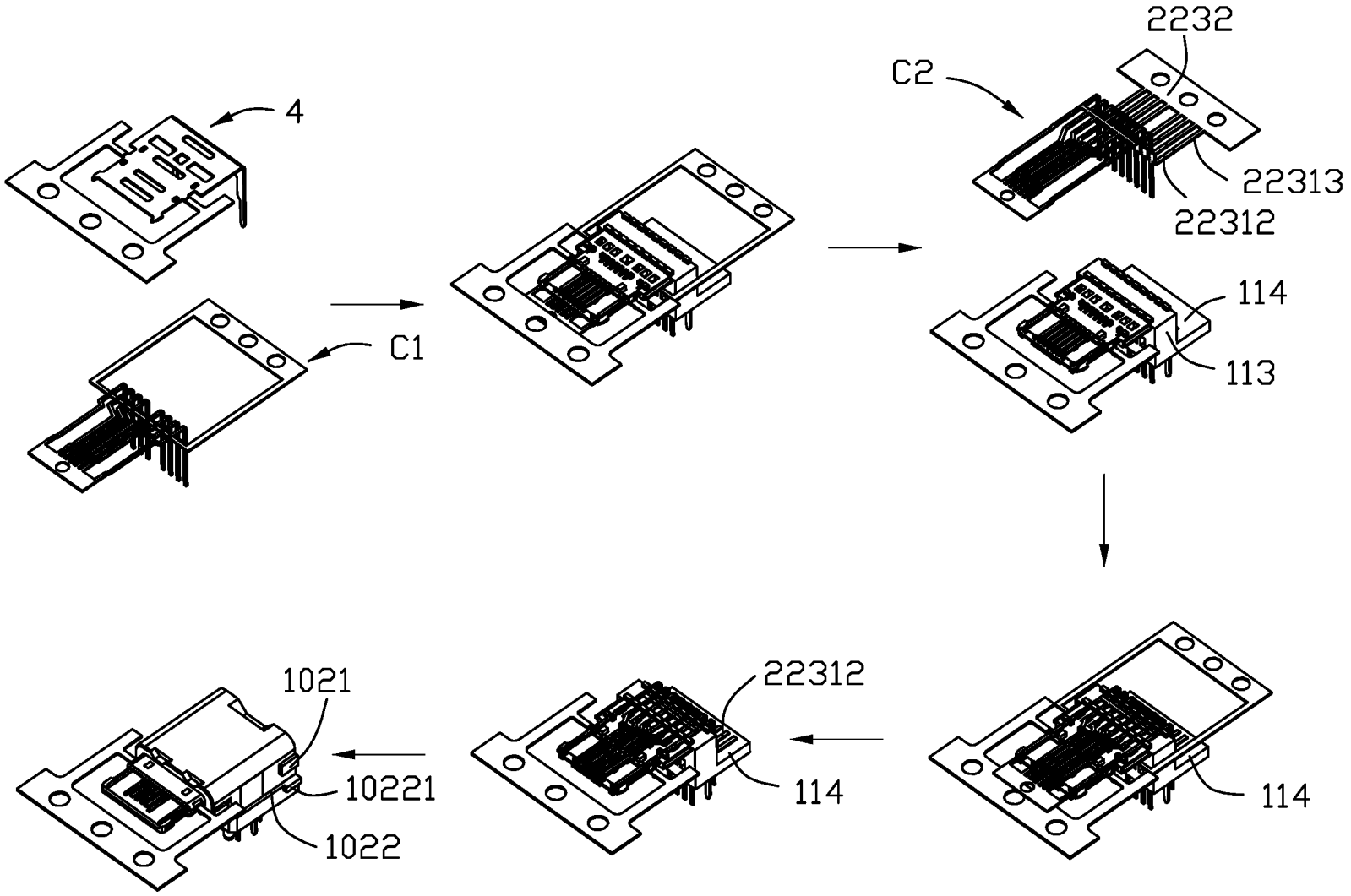
FIG. 11 is a schematic diagram showing steps of manufacturing the electrical connector.
Figure 11A:
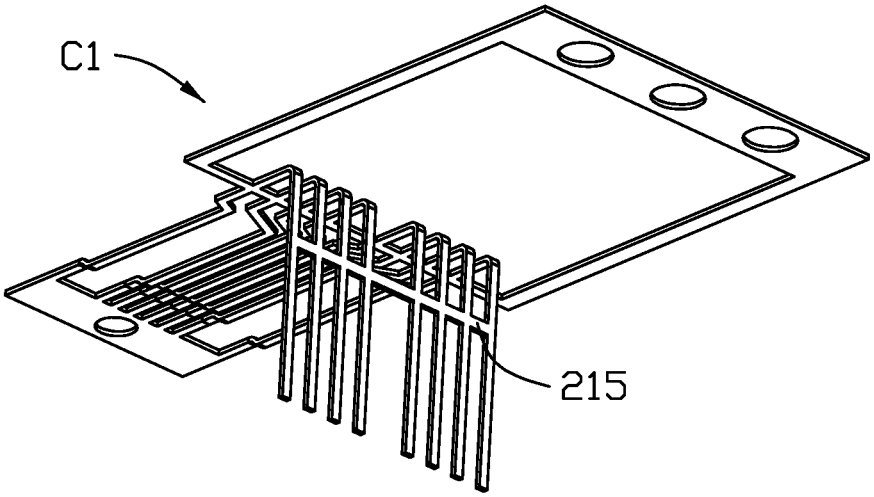
FIG. 11(A) shows the first row C1 of contacts 21 and FIG. 11(B) shows the second row C2 of contacts 22.
Figure 11B:
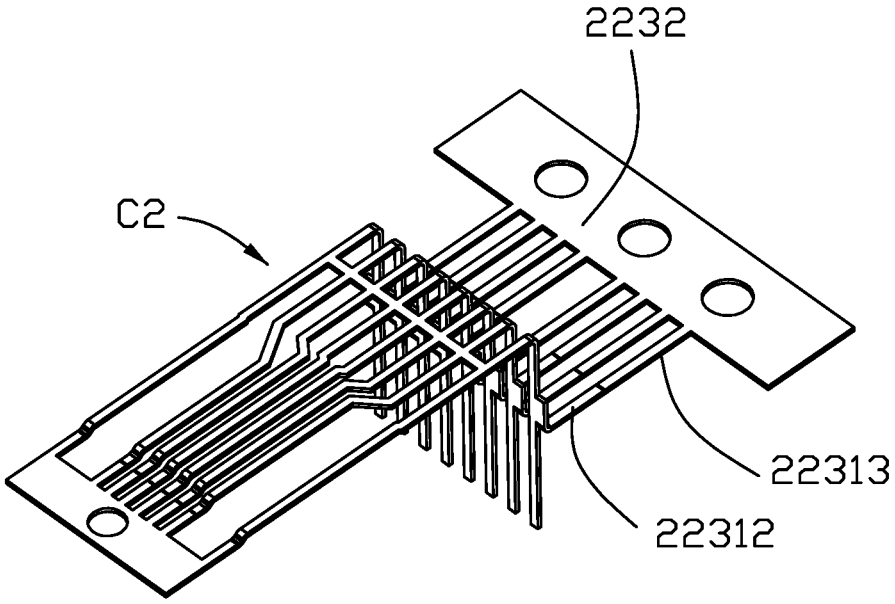
Figure 12:
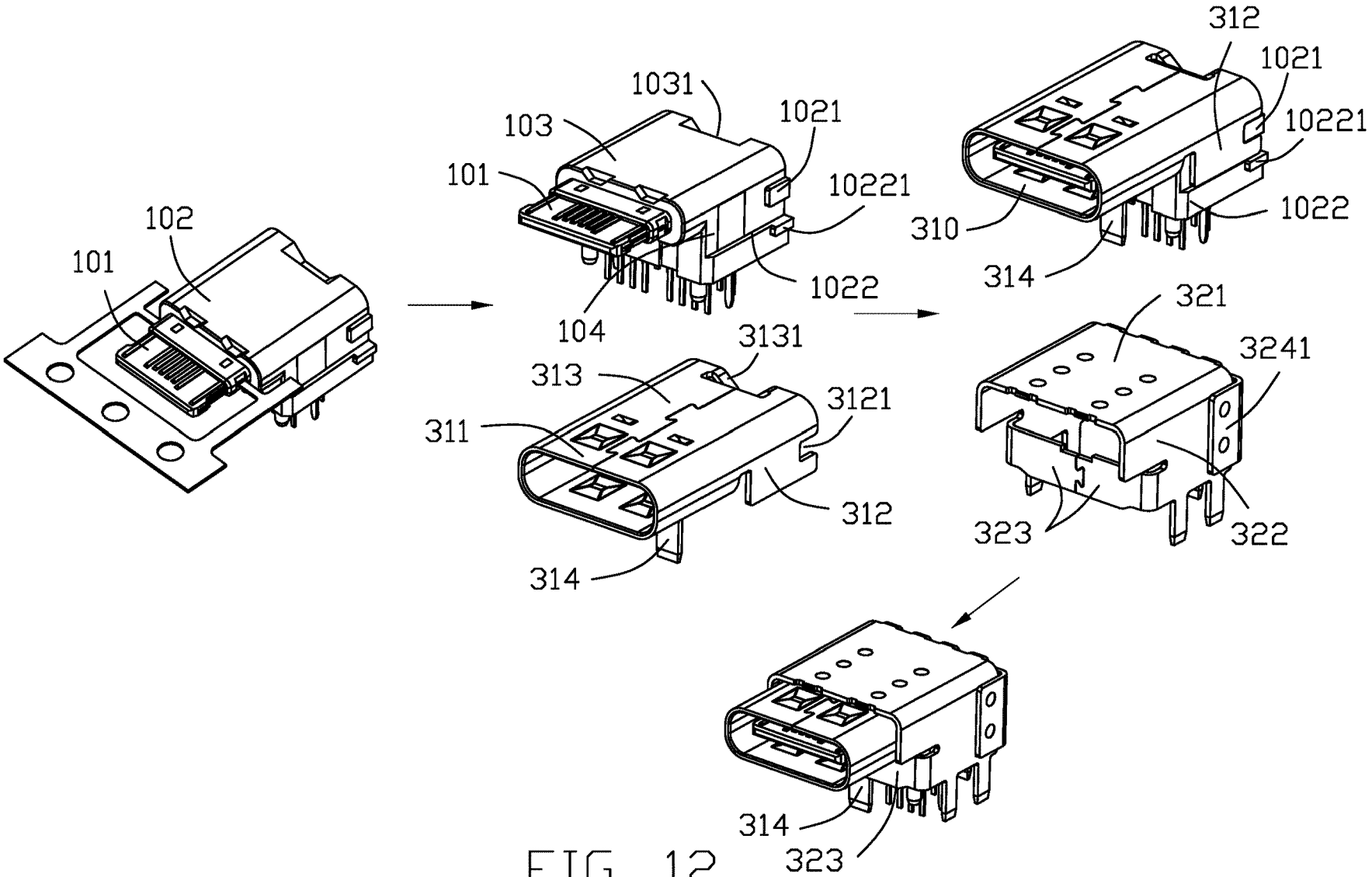
FIG. 12 continues FIG. 11.

A method of making the electrical connector 100 will be described by reference to FIGS. 11 and 12.

Step 1: A contact carrier carrying the first lower row C1 of contacts and another carrier carrying the shielding plate 4 are prepared.

Step 2: The first insulator is molded to the lower row of contacts to have a base, a lower upright portion, and a rear mounting portion.

Step 3: The upper row C2 of contacts are prepared.

Step 4: The upper row C2 of contacts are mounted to the first insulator by inserting tails thereof through the mounting portion 114 of the first insulator until the bearing portions thereof bear against the mounting portion 114.

Step 5: The carrier strip 2232 and the severing parts 22313 are removed from the bearing portions of the upper row of contacts.

Step 6: The second insulator is molded with the upper and lower rows of contacts as well as the first insulator to expose the upper and lower contacting portions of the upper and lower rows of contacts while embedding the bearing portions of the upper row of contacts.

Step 7: The primary shell is mounted to the contact module.

Step 8: The secondary shell is mounted to the primary shell.

What is claimed is:

1. A method of making a contact module of an electrical connector which includes a front tongue with two opposite surfaces and an upper and lower rows of contacts with contacting portions exposed to the two opposite surfaces of the tongue, characterized by the steps of:

forming a first insulator to the lower row of contacts to have a base, a lower upright portion, and a rear mounting portion;

mounting the upper row of contacts to the first insulator by inserting tails of the upper row of contacts through the mounting portion of the first insulator until respective bearing portions of the upper row of contacts bear against the mounting portion;

removing a carrier strip from the bearing portions of the upper row of contacts; and molding a second insulator with the upper and lower rows of contacts and the first insulator to expose an upper and lower contacting portions of the upper and lower rows of contacts while embedding the bearing portions of the upper row of contacts.

2. The method as claimed in claim 1, wherein the step of forming comprises forming the first insulator to the lower row of contacts and a shielding plate.

3. The method as claimed in claim 1, wherein the rear mounting portion forms a plurality of vertical holes, and each of the upper row of contacts includes a vertical tail extending through a corresponding one of said vertical holes.

4. The method as claimed in claim 1, wherein each of the lower row of contacts includes a horizontal securing portion behind the corresponding contacting portion, a vertical tail and an upright portion between the securing portion and the vertical tail, a plurality of horizontal bridges originally respectively linked between the neighboring securing portions of the lower row of contacts, and a plurality of vertical bridges originally respectively linked between the upright portions before forming the first insulator and successively removed therefrom by punching through corresponding through holes formed in the first insulator, before molding the second insulator.

5. The method as claimed in claim 4, wherein said through holes in the first insulator are filled with material of the second insulator after molding the second insulator.

6. The method as claimed in claim 4, wherein the through holes corresponding to the horizontal bridges extend in a vertical direction while the through holes corresponding to the vertical bridges extend in a front-to-back direction.

7. An electrical connector comprising:

an insulative housing having a front tongue with two opposite surfaces; and an upper and lower rows of contacts with contacting portions exposed to the two opposite surfaces of the tongue; wherein the insulative housing includes a first insulator molded to the lower row of contacts, the first insulator having a mounting portion;

the upper row of contacts are separately mounted to the molded first insulator and lower row of contacts, each of the upper row of contacts having an upright portion, a connecting part coplanar with the upright portion, and a portion bent from the connecting part and bearing against the mounting portion of the first insulator; and the insulative housing further includes a second insulator molded to the upper and lower rows of contacts and the first insulator, the second insulator embedding the portions of the upper row of contacts bearing against the mounting portion.

8. The electrical connector as claimed in claim 7, further comprising a shielding plate, and wherein the first insulator is molded to the lower row of contacts and the shielding plate.

9. The electrical connector as claimed in claim 7, wherein each of the upper row of contacts includes a vertical tail extending through a corresponding vertical hole formed in the mounting portion.

10. The electrical connector as claimed in claim 7, wherein each of the lower row of contacts includes a horizontal securing portion behind a corresponding contacting portion, a vertical tail and an upright portion between the horizontal securing portion and the vertical tail, a plurality of horizontal bridges originally respectively linked between neighboring horizontal securing portions of the lower row of contacts, and a plurality of vertical bridges originally respectively linked between the upright portions before forming the first insulator and successively removed therefrom by punching through corresponding through holes formed in the first insulator, before the second insulator is molded.

11. The electrical contact as claimed in claim 10, wherein said through holes are filled with material of the second insulator after the second insulator is molded.

12. The method as claimed in claim 10, wherein the through holes corresponding to the horizontal bridges extend in a vertical direction while the through holes corresponding to the vertical bridges extend in a front-to-back direction.

13. An electrical connector comprising:

an insulative housing having a front tongue with two opposite surfaces; and an upper and lower rows of contacts with contacting portions exposed to the two opposite surfaces of the tongue; wherein the insulative housing includes a first insulator integrally molded to the lower row of contacts via a first insert-molding process, the first insulator having a mounting portion with a plurality of vertical holes extending therethrough in a vertical direction;

the upper row of contacts are separately mounted to the molded first insulator and lower row of contacts, each of the upper row of contacts having a securing portion behind the corresponding contacting portion, a vertical tail and an upright portion between the securing portion and the vertical tail;

the insulative housing further includes a second insulator integrally formed with the upper row of contacts and the molded first insulator and lower row of contacts via a second insert-molding process; wherein the vertical tails of the upper row of contacts extend through corresponding vertical holes in the mounting portion; and each of the lower row of contacts includes a horizontal securing portion behind the corresponding contacting portion, a vertical tail and an upright portion between the horizontal securing portion and the vertical tail, a plurality of horizontal bridges originally respectively linked between neighboring horizontal securing portions of the lower row of contacts, and a plurality of vertical bridges originally respectively linked between the upright portions before forming the first insulator and successively removed therefrom by punching through corresponding through holes formed in the first insulator before the second insulator is formed.

14. The electrical connector as claimed in claim 13, wherein said through holes are filled with material of the second insulator after the second insulator is formed.

15. The electrical connector as claimed in claim 13, wherein the through holes corresponding to the horizontal bridges extend in the vertical direction while the through holes corresponding to the vertical bridges extend in a front-to-back direction.

16. The electrical connector as claimed in claim 13, wherein each of the vertical holes defines an upward divergent opening for facilitating downward insertion of the vertical tail of the corresponding one of the upper row of contacts, and is filled with material of the second insulator after the second insulator is formed.

* * * * *